US011399644B1

(12) United States Patent
Robillard

(10) Patent No.: US 11,399,644 B1
(45) Date of Patent: Aug. 2, 2022

(54) BEVERAGE CONTAINER WITH HANDLE AND METHOD OF MAKING SAME

(71) Applicant: Aakron Rule Corp., Akron, NY (US)

(72) Inventor: Danielle Robillard, Akron, NY (US)

(73) Assignee: Aakron Rule Corp., Akron, NY (US)

( * ) Notice: Subject to any disclaimer, the term of this patent is extended or adjusted under 35 U.S.C. 154(b) by 0 days.

(21) Appl. No.: 16/928,082

(22) Filed: Jul. 14, 2020

(51) Int. Cl.
*B65D 25/28* (2006.01)
*A47G 19/22* (2006.01)
*A47G 23/02* (2006.01)

(52) U.S. Cl.
CPC ..... *A47G 19/2205* (2013.01); *A47G 23/0216* (2013.01)

(58) Field of Classification Search
CPC ..... A47G 19/2205; A47G 19/2266; A47G 23/0216; B65D 25/28; B62B 2204/06; B62B 5/067
USPC ..... 220/759, 737, 756; 215/396
See application file for complete search history.

(56) References Cited

U.S. PATENT DOCUMENTS 4,643,326 A * 2/1987 Klingler ..... A47G 23/0233 220/212.5
5,586,682 A * 12/1996 Yeh ..... A47G 19/22 220/4.24
2011/0284047 A1* 11/2011 Johnson ..... A47J 33/00 136/205
2012/0080439 A1* 4/2012 Park ..... A47G 19/2288 220/710.5

* cited by examiner

*Primary Examiner* — King M Chu
(74) *Attorney, Agent, or Firm* — David L. Principe; Phillips Lytle LLP

(57) ABSTRACT

A beverage container having a container body with an outer surface with at least one tab. A handle having a grip end and an attachment end is configured for attachment to the container body. The attachment end having at least one clip. The container body is printed with a wrap imprint over the tab. The wrap imprint may be a full wrap imprint. The handle is secured to the container body through engagement of the at least one tab with the at least one clip.

22 Claims, 4 Drawing Sheets

BEVERAGE CONTAINER WITH HANDLE AND METHOD OF MAKING SAME

TECHNICAL FIELD

This disclosure relates to a beverage container with a handle, and in particular to a method of manufacturing a beverage container with a wrap imprint in the area where a handle is attached.

BACKGROUND OF THE INVENTION

It is desirable to create aesthetically pleasing wrap imprint designs on drinkware or beverageware that has a handle. Due to the configuration of drinkware or beverageware containing a handle and the resulting obstruction formed by the handle it is difficult to provide a wrap imprint in the area where the handle is attached. Accordingly, there is a need for a device and method of providing a beverage container having a handle with a wrap imprint.

SUMMARY OF THE INVENTION

With parenthetical reference to the corresponding parts, portions or surfaces of the disclosed embodiment, merely for the purposes of illustration and not by way of limitation, the present invention meets the above described need by providing a beverage container having a container body (20) having an outer surface (26) with at least one tab (23).

A handle (29) having a grip end (59) and an attachment end (35, 38) is configured for attachment to the container body (20). The attachment end (35, 38) has at least one clip (56) disposed thereon.

The container body (20) is printed with a wrap imprint, and the handle (29) is secured to the container body (20) through engagement of the at least one tab (23) with the at least one clip (56).

In another aspect of the invention, the wrap imprint is a full wrap imprint covering substantially the entire outer surface of the container body.

In another aspect of the invention, the handle (29) is further secured to the container body (20) with a plug member (62) fixedly attached to the handle (29) adjacent to the clip (56).

In another aspect of the invention, the clip (56) slidably engages the tab (23) and securely locks into place.

In yet another aspect of the invention, the container body (20) has two tabs (23) and the handle attachment end has a top portion (35) with a first clip (56) and a bottom portion (38) with a second clip (56).

Another aspect of the invention includes wherein said at least one tab (23) extends outward from said outer surface by less than about 2 mm.

In another aspect of the invention, the container body (20) is made from stainless steel, and wherein said outer surface (26) is a cylindrical surface.

In yet another aspect of the invention, the beverage container includes a container body (20) having an outer surface (26). A low profile tab (23) is mounted on the outer surface (26) of the container body (20). The low profile tab (23) has a middle portion (89) disposed in spaced apart relation to the outer surface (26) of the container body (20). The middle portion (89) has an opening (95) defined therein. A handle (29) has a grip end (59) and an attachment end (35, 38). The attachment end (35, 38) includes at least one clip (56) with a prong (74) disposed thereon. The prong (74) is configured to slide between the middle portion (89) of the low profile tab (23) and the outer surface (26) of the container body (20) and to engage with the low profile tab (23) inside the opening (95) in the middle portion (89) when the handle (29) is attached to the container body (20). The container body (20), with the low profile tab (23) mounted thereon, is configured to receive a wrap imprint over the tab (23) prior to attachment of the handle (29).

DESCRIPTION OF THE PREFERRED EMBODIMENTS

Figure 1:
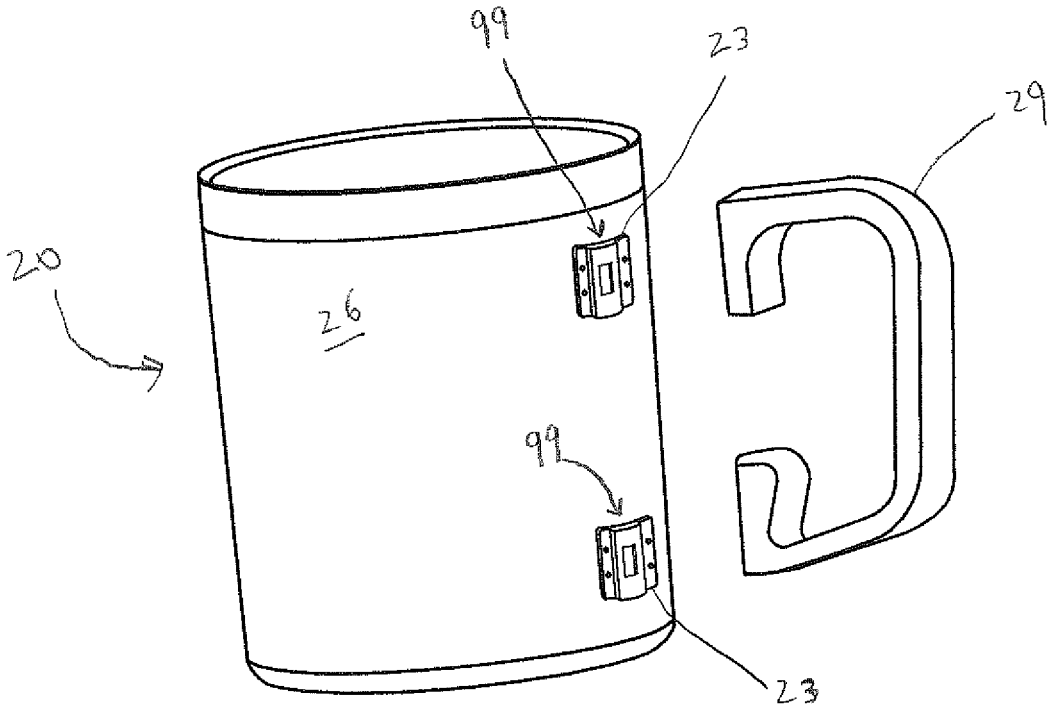
FIG. 1 is an exploded perspective view of the beverage container according to one embodiment of the disclosure.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read together with the specification, and are to be considered a portion of the entire written description of this invention.

Figure 12:
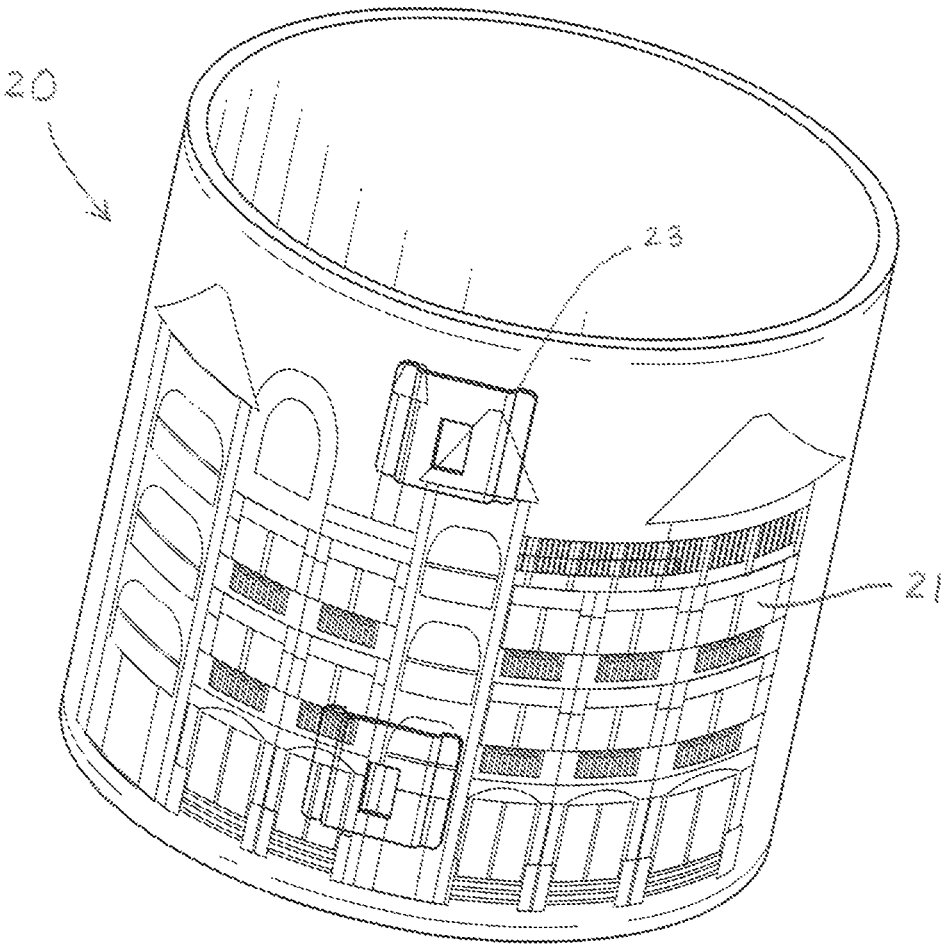
FIG. 12 is a perspective view of the container body with a full wrap imprint therein prior to attachment of the handle.

Referring to the figures generally and initially to FIG. 1, a container body 20 is provided in connection with the construction of a beverage container for holding hot or cold beverages. The container body 20 may have a cylindrical shape and may be constructed of various materials including plastic, stainless steel or the like. The embodiment shown in FIG. 1 is a mug or coffee cup style version showing one example of the invention. Other shapes and sizes of beverageware or drinkware are also included in the invention. More specifically, any shape or style of beverageware or drinkware having an imprint applied in an area where a handle is to be attached is suitable for the present invention. The container body 20 may be provided with a pair of low profile tabs 23 that may be attached to the outer surface 26 of the body 20. The tab 23 may be attached to the container body by various means including fasteners such as screws or by welding or the like. The low profile tabs 23 may extend from the outer surface 26 by approximately 2 mm. The low profile tabs 23 provide clearance such the container body 20, without modification, may be inserted into a machine to provide a wrap imprint over the tab 23, in the area where the handle 29 is attached, prior to attaching the handle 29. As shown in FIG. 12, a full wrap imprint 21 is provided when substantially the entire outer surface 26 of the container body 20 is printed with a pattern or design. The full imprint 21 may be provided by a machine that rotates the container body 20 three hundred sixty degrees while printing. The low profile tabs 23 and handle 29 are described in greater detail herein.

Figure 2:
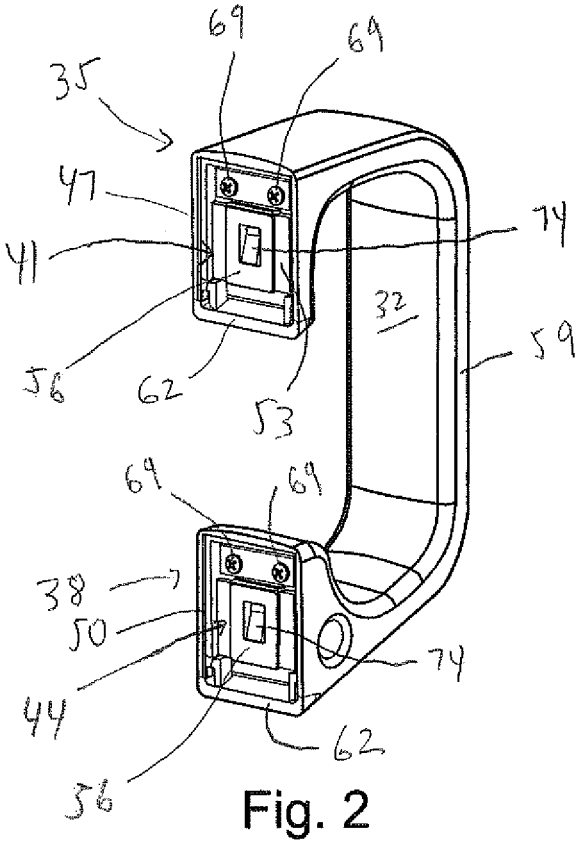
FIG. 2 is a perspective view of the beverage container handle, showing the handle attachment clips according to one embodiment of the disclosure.
Figure 3:
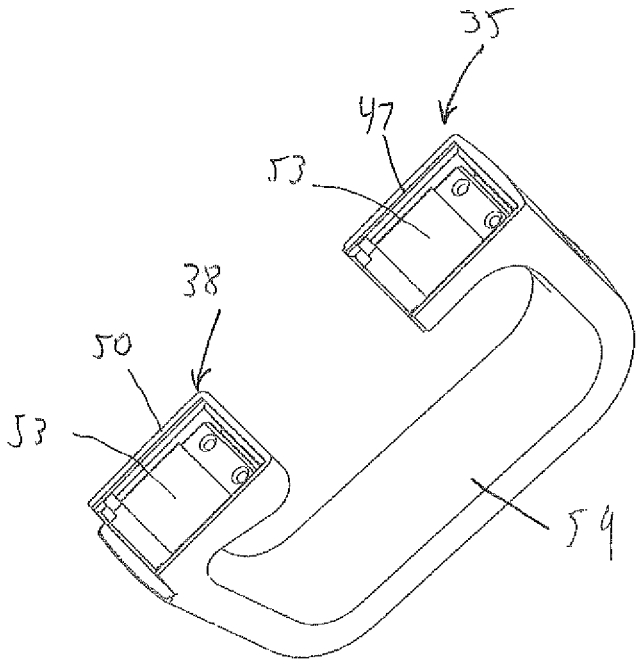
FIG. 3 is a perspective view of the beverage container handle of FIG. 2, without the handle attachment clips.
Figure 4:
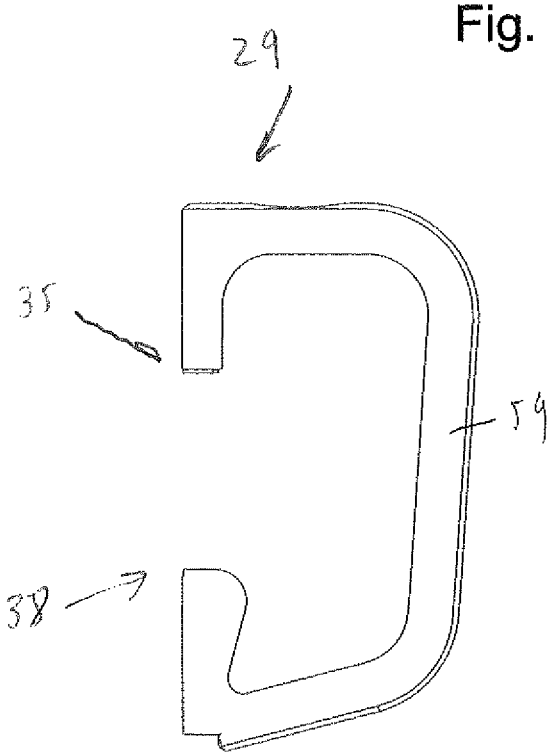
FIG. 4 is a side view of the beverage container handle of FIG. 3.
Figure 5:
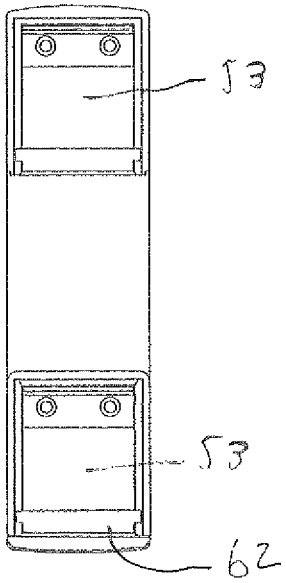
FIG. 5 is a front view of the beverage container handle of FIG. 3.

Turning to FIGS. 2-5, the handle 29 has an elongate body 32 that extends to a first attachment end 35 and a second attachment end 38 disposed opposite from the first attachment end 35. The attachment ends 35, 38 are provided with openings 41, and 44 that are bordered at the edges by the ends 47, 50 of the elongate body 32. The bottom of the openings 41 and 44 are bordered by a recessed surface 53 (FIG. 3). The recessed surface 53 provides a space for mounting a clip 56 therein as shown in FIG. 2. The clip 56 is described in greater detail herein. The lower portion of the first and second attachment ends 35, 38 may be provided with a plug member 62 (FIG. 2). The plug members 62 cover the bottom of the openings 41 and 44 after the handle 29 is installed as described herein. The handle 29 also has a grip end 59 where the user grasps the handle 29 to lift the beverage container.

Figure 6:
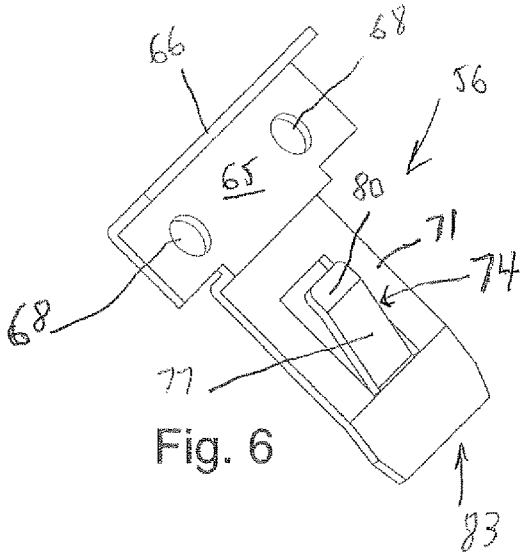
FIG. 6 is a perspective view of a handle attachment clip according to one embodiment of the disclosure.
Figure 7:
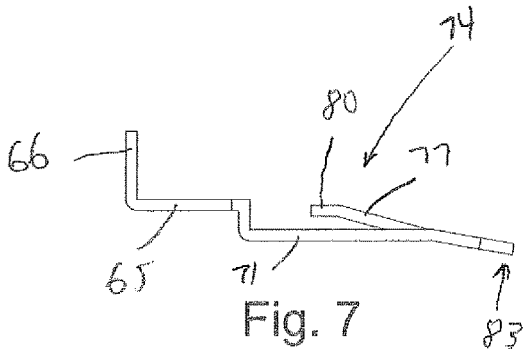
FIG. 7 is a side view of the handle attachment clip of FIG. 6.

In FIGS. 6-7, the clip 56 may be provided with a header portion 65 having a pair of openings 68 defined therein. The openings 68 provide for inserting fasteners 69 (FIG. 1) to mount the clip 56 to the handle 29. A vertical wall 66 extends upward from the header portion 65. The header portion 65 is disposed adjacent to a base portion 71 having a prong 74 extending upward and outward therefrom. The prong 74 may be provided with an angled portion 77 extending at an angle from the base portion 71. The prong 74 may also have a distal portion 80 disposed at the end of the angled portion 77 and extending substantially parallel to the base portion 71. As best shown in FIG. 7, the front of the clip 56 may be angled downward at the end 83. The header portion 65 is raised above the surface of the base portion 71 and is approximately level with the distal portion 80 of the prong 74. The prong 74 has elastic spring properties such that it is capable of deflecting downward toward the base portion 71 and then returning to its original shape.

Figure 8:
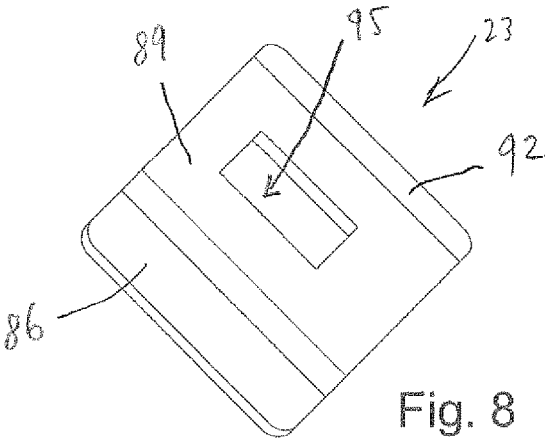
FIG. 8 is a perspective view of the beverage container handle connection tab according to one embodiment of the disclosure.
Figure 9:
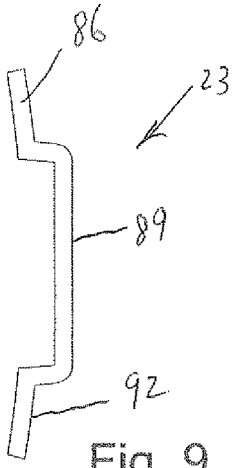
FIG. 9 is a side view of the beverage container handle connection tab of FIG. 8.

Turning to FIGS. 8-9, the low profile tab 23 may be provided with a flat U-shape in cross section. A first section 86 extends toward a raised middle portion 89. A second section 92 is disposed on the side opposite from the first section 86. The middle portion 89 has an opening 95 defined therein. The opening 95 may have a rectangular shape as shown. When the tab 23 is installed on the container body 20, a slot 99 (FIG. 1) is formed where the middle portion 89 is disposed in spaced apart relation to the outer surface 26 of the container body 23.

Figure 10:
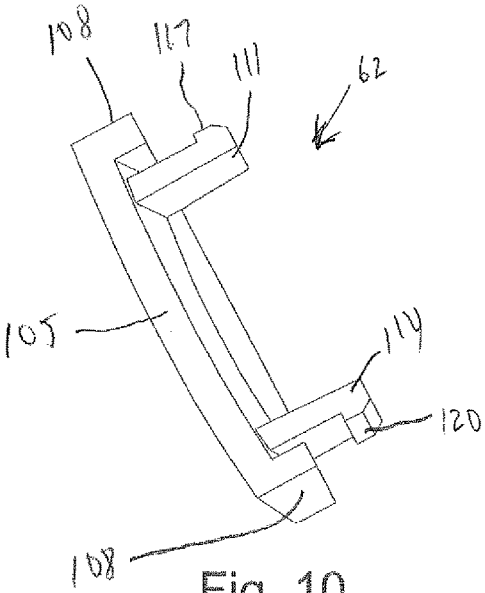
FIG. 10 is a perspective view of the beverage container handle plug member according to one embodiment of the disclosure.
Figure 11:
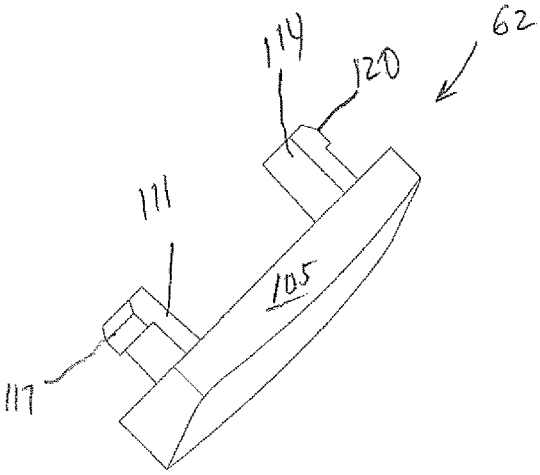
FIG. 11 is another view of the beverage container handle plug member of FIG. 10.

Turning to FIGS. 10-11, the plug member 62 has a body 102 shaped to match the shape of the first and second attachment members 35, 38 with a facing wall 105 and a pair of side walls 108. A pair of upstanding members 111 and 114 extend from the body 102 and include prongs 117 and 120 extending outward. The upstanding members 11, 114 are capable of deflecting inward and frictionally engaging with the inside walls surrounding openings 41 and 44.

In use, the low profile tabs 23 are attached to the outer surface 26 of the container body 20 as shown in FIG. 1. The container body 20, with the low profile tabs 23 mounted thereon, is placed in an imprinting machine where the subassembly is rotated up to three hundred sixty degrees for printing on the outer surface 26 including the area where the tab 23 for attaching the handle 29 is located. Next, the handle 29 is positioned above the tabs 23 and adjacent to the outer surface 26. The handle 29 is slid downward relative to the outer surface 26 such that the end 83 and base portion 71 of the clip 56 slide between the outer surface 26 and the middle portion 89 of the tab 23. As the handle 29 slides downward, the prong 74 attached to the base portion 71 deflects inward via engagement with the inside of the middle portion 89 of the tab 23. When the prong 74 reaches the opening 95, the prong 74 springs outward and locks the handle 29 into position on the container body 20. Next, the plug member 62 is attached at the lower portion of the first and second attachment ends 35, 38 to cover the lower end of the openings 41, 44.

The present invention contemplates that many changes and modifications may be made. Therefore, while the presently-preferred form of the beverage container has been shown and described, and several modifications and alternatives discussed, persons skilled in this art will readily appreciate that various additional changes and modifications may be made without departing from the spirit of the invention, as defined and differentiated by the following claims.

What is claimed is:

1. A beverage container, comprising:

a container body having an outer surface with at least one tab;

a handle having a grip end and an attachment end, said attachment end comprising at least one clip;

wherein said container body is printed with an imprint over the tab; and wherein said handle is secured to said container body through engagement of said at least one tab with said at least one clip.

2. The beverage container of claim 1, wherein the imprint is a full wrap imprint.

3. The beverage container of claim 1, wherein said handle is further secured to said container body with a plug member fixedly attached to said handle adjacent to said clip.

4. The beverage container of claim 1, wherein said at least one clip slidably engages said at least one tab and securely locks into place.

5. The beverage container of claim 1, wherein said container body has two tabs and said handle attachment end has a top portion with a first clip and a bottom portion with a second clip.

6. The beverage container of claim 1, wherein said at least one tab extends outward from said outer surface by less than about 2 mm.

7. The beverage container of claim 1, wherein said container body is made from stainless steel, and wherein said outer surface is a cylindrical surface.

8. The beverage container of claim 1, wherein said at least one tab is welded to said container body.

9. The beverage container of claim 1, wherein said at least one clip is secured to said handle attachment end with at least one fastener.

10. The beverage container of claim 1, wherein said handle is not detachable from said container body after engagement of said at least one tab with said at least one clip.

11. A method of manufacturing a beverage container, comprising:

providing a container body having an outer surface configured to receive at least one tab;

securing each said tab to said outer surface;

printing a wrap imprint on said outer surface over the tab;

providing a handle having a grip end and an attachment end;

fixedly securing a clip to said attachment end of said handle; and fixedly securing said handle to said container body through engagement of said at least one tab with said at least one clip.

12. The method of claim 11, wherein said printing is done after said securing said at least one tab to the container body.

13. The method of claim 11, further comprising fixedly attaching at least one plug member to said handle adjacent to each said at least one clip.

14. The method of claim 11, wherein said at least one tab extends outward from said outer surface by less than about 2 mm.

15. The method of claim 11, wherein said container body is made from stainless steel, and wherein said outer surface is a cylindrical surface.

16. The method of claim 11, wherein said at least one tab is welded to said container body.

17. The method of claim 11, wherein said at least one clip is secured to said handle attachment end with at least one fastener.

18. A beverage container, comprising:

a container body having an outer surface;

a low profile tab mounted on the outer surface of the container body, the low profile tab having a middle portion disposed in spaced apart relation to the outer surface of the container body, the middle portion having an opening defined therein, the opening surrounded by the middle portion, the low profile tab defining a top opening formed between a top edge of the middle portion and the container body;

a handle having a grip end and an attachment end, the attachment end comprising at least one clip with a prong disposed thereon, the prong configured to slide into the top opening between the middle portion of the tab and the outer surface of the container body and the prong configured and arranged to have spring properties to such that the prong engages with the inside surface of the middle portion until it reaches the opening where it deflects into the opening to lock the handle into a fixed connection with the container body;

wherein the container body with the low profile tab mounted thereon is has a wrap imprint over the tab underneath the handle.

19. The beverage container of claim 18, wherein the wrap imprint is a full wrap imprint.

20. A beverage container, comprising:

a container body having an outer surface;

a low profile tab mounted on the outer surface of the container body, the low profile tab having a middle portion disposed in spaced apart relation to the outer surface of the container body, the middle portion having an opening defined therein;

a handle having a grip end and an attachment end, the attachment end comprising at least one clip with a prong disposed thereon, the prong configured to slide between the middle portion of the tab and the outer surface of the container body and to engage with the low profile tab inside the opening in the middle portion when the handle is attached to the container body; wherein the container body with the low profile tab mounted thereon is configured to receive a wrap imprint over the tab prior to attachment of the handle wherein said handle is further secured to said container body with a plug member fixedly attached to said handle adjacent to said clip.

21. The beverage container of claim 18, wherein said container body has two low profile tabs and said handle attachment end has a top portion with a first clip and a bottom portion with a second clip.

22. The beverage container of claim 18, wherein said at least one tab extends outward from said outer surface by less than about 2 mm.

* * * * *